US010710613B2

(12) United States Patent
Liu et al.

(10) Patent No.: US 10,710,613 B2
(45) Date of Patent: Jul. 14, 2020

(54) RAILWAY FREIGHT CAR BOGIE

(71) Applicant: CRRC QIQIHAR ROLLING STOCK CO., LTD., Qiqihar (CN)

(72) Inventors: Zhenming Liu, Qiqihar (CN); Shifeng Xu, Qiqihar (CN); Xinqiang Liu, Qiqihar (CN); Shanchao Xu, Qiqihar (CN); Weigang Kong, Qiqihar (CN)

(73) Assignee: CRRC QIQIHAR ROLLING STOCK CO., LTD., Qiqihar, Heilongjiang (CN)

( * ) Notice: Subject to any disclaimer, the term of this patent is extended or adjusted under 35 U.S.C. 154(b) by 300 days.

(21) Appl. No.: 15/835,260

(22) Filed: Dec. 7, 2017

(65) Prior Publication Data

US 2019/0023289 A1 Jan. 24, 2019

(30) Foreign Application Priority Data

Jul. 24, 2017 (CN) ..... 2017 1 0607991

(51) Int. Cl.
*B61F 5/12* (2006.01)
*B61F 5/14* (2006.01)
*B61F 5/06* (2006.01)

(52) U.S. Cl.
CPC ..... *B61F 5/122* (2013.01); *B61F 5/06* (2013.01); *B61F 5/14* (2013.01)

(58) Field of Classification Search
CPC .. B61F 5/12; B61F 5/122; B61F 5/125; B61F 5/127; B61F 5/06; B61F 5/14; B61F 5/142; B61F 5/144
See application file for complete search history.

(56) References Cited

U.S. PATENT DOCUMENTS 3,461,815 A * 8/1969 Brown ..... B61F 5/122 105/198.4
5,511,489 A * 4/1996 Bullock ..... B61F 5/122 105/198.2

(Continued)

FOREIGN PATENT DOCUMENTS

CN 203477152 U 3/2014
WO WO 2011/134263 A1 11/2011

OTHER PUBLICATIONS

Office Action dated Aug. 30, 2019 for India Application No. 201714043745, 6 pages.

(Continued)

*Primary Examiner* — Jason C Smith
(74) *Attorney, Agent, or Firm* — Patterson Thuente Pedersen, P.A.

(57) ABSTRACT

A railway freight car bogie includes a side frame, a bolster and a friction damper. The friction damper includes a wedge, a constant friction damping spring, a variable friction damping spring and an ejector rod. The variable friction damping spring in the middle and below the wedge is deviated at a distance in a direction away from a center of the bolster with respect to damping springs at two sides of the variable friction damping spring. An axis of each of the constant friction damping spring and the ejector rod is coincident with an axis of the variable friction damping spring in the middle and below the wedge. The bogie not only has an ideal relative friction coefficient in both an unloaded condition and a loaded condition, a large diamond resistant rigidity, a better vertical dynamics performance and a better transverse dynamics performance.

17 Claims, 3 Drawing Sheets

(56) References Cited

U.S. PATENT DOCUMENTS

| | | | | |
|---|---|---|---|---|
| 8,689,701 | B2 * | 4/2014 | Sun | B61F 5/122<br>105/197.05 |
| 2013/0008337 | A1 * | 1/2013 | Liu | B61F 5/12<br>105/198.2 |
| 2014/0165871 | A1 * | 6/2014 | Xu | B61F 5/52<br>105/206.1 |
| 2015/0367866 | A1 * | 12/2015 | Yin | B61F 5/06<br>105/197.05 |
| 2015/0367867 | A1 * | 12/2015 | Xu | B61F 5/305<br>105/197.05 |
| 2019/0023289 | A1 * | 1/2019 | Liu | B61F 5/14 |

OTHER PUBLICATIONS

Australian Examination Report No. 1 for Application No. 2018200203, dated Nov. 30, 2018 (5 pgs).

* cited by examiner

RAILWAY FREIGHT CAR BOGIE

CROSS REFERENCE OF RELATED APPLICATION

The present application claims the priority to Chinese Patent Application No. 201710607991.3, titled "RAILWAY FREIGHT CAR BOGIE", filed on Jul. 24, 2017 with the State Intellectual Property Office of the People's Republic of China, the content of which application is incorporated herein by reference in its entirety.

FIELD

The present application relates to the technical field of railway vehicles, and particularly to a core component of a railway freight car, that is a bogie.

BACKGROUND

A railway freight car generally includes a car body, a bogie, a brake device, a coupler and draft gear and other components. The bogie functions to support the car body, to guide the car to travel along a track and to withstand various loads from the car body and lines. The most common bogie of the railway freight car is a two-axle cast steel three-piece bogie including a bolster, two side frames, two wheelsets, a spring damping device, a brake device and so on.

The most commonly used damper for the bogie of the freight car is a friction damper, which includes a wedge, a damping spring and other parts. The damper is arranged in a space enclosed by the side frame and the bolster. The friction damper converts, by the effect of the angle of the wedge, a vertical support force of the spring into a horizontal side pressure of the wedge against a side frame upright column. The side frame upright column is fitted with a wear plate at a position opposite to the wedge, and a friction exists between the wedge and the wear plate. As the car body vibrates up and down, the bolster also vibrates up and down to drive the wedge to move up and down and thus cause the wedge and the wear plate to rub each other, thereby generating a friction force, that is, a damping force.

The friction damper may be classified into a constant friction damper and a variable friction damper, where the damping force of the constant friction damper is a constant and does not change with the change of a loading force, and thus it is impossible to achieve that a relative friction coefficient is within an ideal value range in both an unloaded condition and a loaded condition, and it is impossible to take into account both the unloaded condition and the loaded condition, therefore the car has a poor vertical dynamics performance.

The variable friction damper includes a wedge, a constant friction damping spring, a variable friction damping spring, an ejector rod and so on. A bottom plate under a wedge groove of the bolster has a hole. The ejector rod has an upper portion located inside the constant friction damping spring which is located in the wedge, and has a lower portion passing through the hole of the wedge groove of the bolster to be in contact with the variable friction damping spring. In the unloaded condition, the damping force is only provided by the constant friction damping spring. In the loaded condition, an inner top portion of the wedge is in contact with an upper end of the ejector rod and thus the wedge may compress the variable friction damping spring downward, therefore the damping force is provided by the constant friction damping spring and the variable friction damping spring together. Therefore, the relative friction coefficient can be within the ideal value range both in the unloaded condition and in the loaded condition, and both the unloaded condition and the loaded condition can be taken into account, and thus the car has a better vertical dynamics performance.

However, this kind of variable friction damper still has disadvantages. Specifically, since the constant friction damping spring and the ejector rod must be aligned with an axis of a variable friction damping inner spring, positions of the constant friction damping spring and which results in that the wedge have to be close to a center line of the bolster and thus a structural part between two wedge grooves of the bolster becomes smaller in size, which reduces strength of the bolster, thereby adversely affecting a service performance of the bogie.

Therefore, it is a technical issue to be addressed by the person skilled in the art to further improve the strength of a wedge groove part of the bolster so as to improve the service performance of the bogie.

SUMMARY

An object of the present application is to provide a bogie of a railway freight car. The bogie not only has an ideal relative friction coefficient both in an unloaded condition and in a loaded condition, a large diamond resistant rigidity, a better vertical dynamics performance and a better transverse dynamics performance; but also overcomes the disadvantages of an existing bogie with a double-action damper and can improve a structural strength of the bolster significantly, thereby ensuring the service performance of the bogie.

In order to achieve the above object, it is provided according to the present application a railway freight car bogie which includes a side frame, a bolster and a friction damper provided between the side frame and the bolster. The friction damper includes a wedge, a constant friction damping spring, a variable friction damping spring and an ejector rod. The bolster is provided with a through hole in a bottom plate under a wedge groove. An upper portion, passing through the through hole, of the ejector rod is located inside the constant friction damping spring which is located in the wedge, and a lower portion of the ejector rod is in contact with the variable friction damping spring. The variable friction damping spring below the wedge and in the middle is deviated at a distance in a direction away from the center of the bolster with respect to damping springs at two sides of the variable friction damping spring. An axis of each of the constant friction damping spring and the ejector rod is coincident with an axis of the variable friction damping spring in the middle and below the wedge.

Preferably, a support is provided between a lower end of the ejector rod and an upper end of the variable friction damping spring, and a center line of the support is coincident with the axis of each of the constant friction damping spring and the ejector rod.

Preferably, a bottom surface of the ejector rod is provided with a conical depression, and a top surface of the support is provided with a conical protrusion matching with the depression.

Preferably, a circular sunken pit is provided in a bearing seat of the side frame, and a lower end of the variable friction damping spring is fitted into the sunken pit.

Preferably, a distance of a bottom portion of the sunken pit from a bottom surface of the bearing seat is 20% to 50% of a height of the bearing seat, and a distance of a side of the sunken pit from a side wall of the bearing seat is 20% to 40% of the height of the bearing seat.

Preferably, an inner top surface of the wedge is provided with a downward inverted conical bulge, and the bulge has a root diameter less than an inner diameter of the constant friction damping spring.

Preferably, the wedge is a combined structure including a wedge body and a main friction plate mounted at a façade of the wedge body.

Preferably, an upper end of the ejector rod is provided with a protruding section having a diameter less than an outer diameter of the ejector rod, and the protruding section passes upward, via a hole of the top surface of the wedge, through a top surface of the wedge, and an exposed portion of the protruding section is provided with an annular groove or a transverse hole.

Preferably, the ejector rod is a steel pipe having an inside of a hollow structure.

Preferably, a top surface of the ejector rod is a spherical surface.

In order that the width of an intermediate cross-section of the bolster, that is a size B between the wedge grooves, would not be too small to adversely affect the strength of the bolster, an axis of each of the constant friction damping spring and the ejector rod is designed to be still in alignment with the variable friction damping spring below according to the present application. However, the variable friction damping spring in the middle and below the wedge is deviated at a distance in a direction away from the center of the bolster with respect to damping springs at two sides of the variable friction damping spring, and the axis of each of the constant friction damping spring and the ejector rod is still coincident with an axis of the variable friction damping spring in the middle and below the wedge. In this way, the size B of the structural part between two wedge grooves of the bolster may be widened by a distance A to each of two sides of the structural part, and the widened size becomes B+2A, so that the bogie has an ideal relative friction coefficient both in the unloaded condition and in the loaded condition, and has a large diamond resistant rigidity, a better vertical dynamics performance and a better transverse dynamics performance. Further, the structural strength of the bolster can be improved significantly, thereby ensuring the service performance of the bogie.

REFERENCE NUMERALS IN THE DRAWINGS

Figure 1:
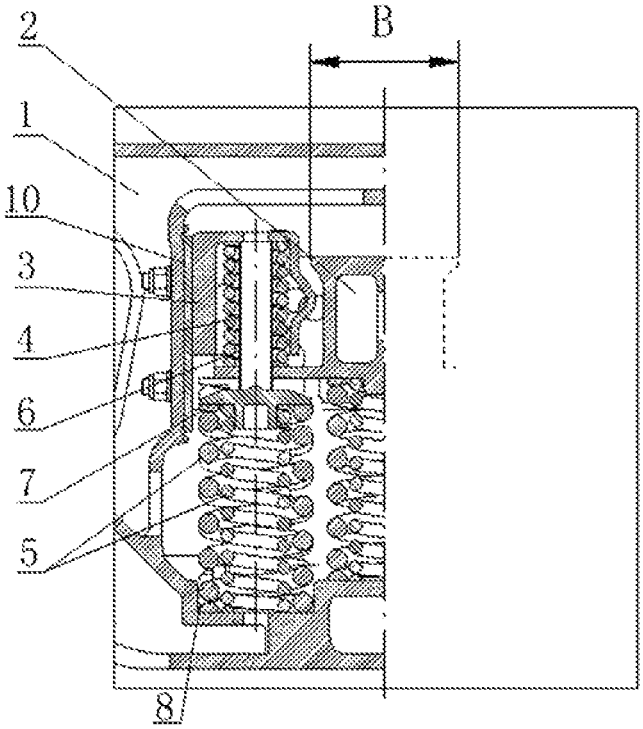
FIG. 1 is a schematic view showing the assembly of a side frame, a bolster and a friction damper of a railway freight car bogie according to the present application.

1. side frame,
2. bolster,
3. wedge,
4. constant friction damping spring,
5. variable friction damping spring,
6. ejector rod,
7. support,
8. sunken pit,
9. bulge,
10. wear plate.

DETAILED DESCRIPTION OF EMBODIMENTS

In order to make those skilled in the art have a better understanding of solutions of the present application, the present application is described in further detail hereinafter, in conjunction with the drawings and embodiments.

Terms such as "upper, lower, inner and outer" are defined herein based on positional relationships shown in the drawings. Depending on different drawings, the corresponding positional relationships may also change, which therefore cannot be interpreted as an absolute limitation to the protection scope.

Reference is made to FIG. 1, which is a schematic view showing assembly of a side frame, a bolster and a friction damper of a railway freight car bogie according to the present application.

As is shown in the figure, a railway freight car bogie in this embodiment mainly includes a side frame 1, a bolster 2 and a friction damper provided between the side frame 1 and the bolster 2. The friction damper includes a wedge 3, a constant friction damping spring 4, a variable friction damping spring 5 (including a variable friction damping inner spring and a variable friction damping outer spring) and an ejector rod 6. A through hole is provided in a bottom plate of the bolster 2 under a wedge groove. An upper portion, passing through the through hole, of the ejector rod 6 is located inside the constant friction damping spring 4 which is located in the wedge 3, and a lower portion of the ejector rod 6 is in contact with the variable friction damping spring 5. Bolster springs (including the variable friction damping spring 5), mounted on a bearing seat at a bottom of the side frame 1, are arranged symmetrically or skew-symmetrically with respect to a center of the bearing seat of the side frame, to ensure that the side frame 1 receives an even force.

It may be seen from the figure that, if positions of the constant friction damping spring 5 and the wedge 3 are too close to a center line of the bolster 2, it may be resulted in that a structural part between two wedge grooves of the bolster 2 has a small size B and the strength of the bolster 2 is reduced, which may adversely affect the service performance of the bogie.

Figure 2:
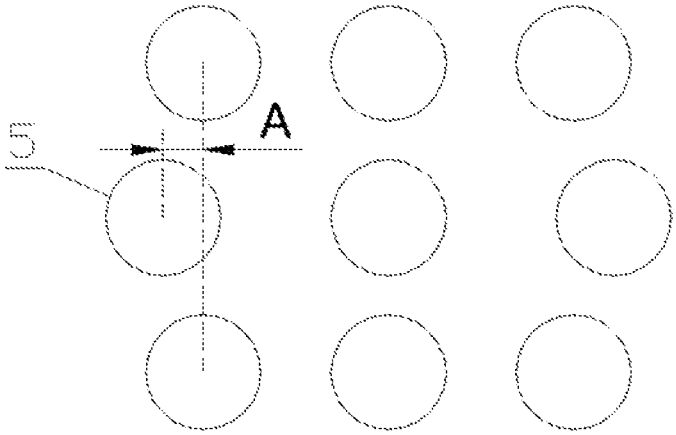
FIG. 2 is a schematic view showing that a variable friction damping spring in the middle and below a wedge is deviated at a distance in a direction away from the center of the bolster with respect to damping springs at two sides of the variable friction damping spring.

Reference is made to FIG. 2 which is a schematic view showing that the variable friction damping spring in the middle and below the wedge is deviated at a distance in a direction away from a center of the bolster with respect to damping springs at two sides of the variable friction damping spring.

As shown in the figure, in order that the width of an intermediate cross-section of the bolster 2, that is the size B, would not be too small to adversely affect the strength of the bolster, here, the variable friction damping spring 5 in the middle and below the wedge is deviated at a distance A in a direction away from the center of the bolster with respect to the damping springs at two sides of the variable friction damping spring 5, and an axis of each of the constant friction damping spring 4 and the ejector rod 6 is still coincident with an axis of the variable friction damping spring 5 in the middle and below the wedge, i.e., the axis of each of the constant friction damping spring 4 and the ejector rod 6 is still remained in alignment with that of the variable friction damping spring 5 below the constant friction damping spring 4 and the ejector rod 6. In this way, the size B of the structural part between the two wedge grooves of the bolster 2 may be widened by the distance A to each of two sides of the structural part, and the size after being widened becomes B+2A, thus can improve structural strength of the bolster 2 significantly, thereby ensuring the service performance of the bogie.

Figure 3:
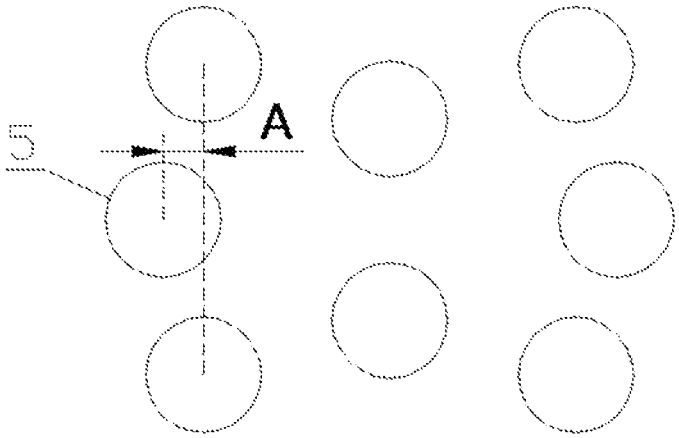
FIG. 3 is a schematic view showing a second distribution of damping springs below the bolster.
Figure 4:
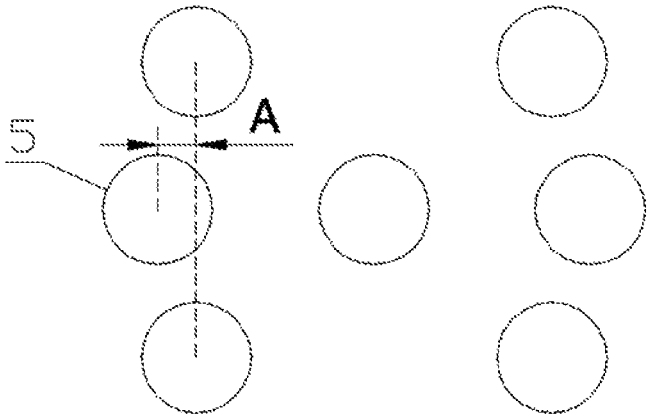
FIG. 4 is a schematic view showing a third distribution of the damping springs below the bolster.

Of course, in a structure shown in FIG. 2, a total of nine sets of damping springs are provided below the bolster. Besides, an arrangement with eight sets of damping springs (see FIG. 3) or seven sets of damping spring (see FIG. 4) may be adopted. It may be seen from the figure that, although the number and the distribution of the damping springs are different, the variable friction damping spring 5 in the middle and below the wedge, in each of the cases, is deviated at the distance A in the direction away from the center of the bolster with respect to the damping springs at two sides of the variable friction damping spring 5.

A support 7 is fitted between a lower end of the ejector rod 6 and an upper end of the variable friction damping spring 5. A center line of the support 7 is coincident with the axis of each of the constant friction damping spring 4, the variable friction damping spring 5 and the ejector rod 6. A bottom surface of the ejector rod is provided with a conical depression, and a top surface of the support is provided with a conical protrusion matching with the depression. Through the conical depression and the conical protrusion, the ejector rod 6 and the support 7, after assembly, are capable of aligning with each other automatically and always located at the same longitudinal axis to ensure that a downwardly transmitted action force may not be deflected, thereby ensuring a damping effect of the springs.

In order to increase flexibility of the variable friction damping inner spring and the variable friction damping outer spring to ensure that they have a large degree of freedom, here, a circular sunken pit 8 is designed in the bearing seat of the side frame to accommodate the variable friction damping spring 5. The sunken pit 8 has a diameter greater than an outer diameter of the variable friction damping outer spring. During assembly, a lower end of the variable friction damping inner spring and a lower end of the variable friction damping outer spring below the wedge 3 are both fitted into the sunken pit 8 simultaneously, and since the variable friction damping inner spring and the variable friction damping outer spring located below the wedge 3 are introduced together as the variable friction damping spring 5, the support 7 should have an outer diameter slightly less than that of the variable friction damping outer spring, so as to press both the variable friction damping inner spring and the variable friction damping outer spring simultaneously.

As a further solution, the sunken pit 8 may have a diameter greater than an outer diameter of the variable friction damping inner spring and less than an inner diameter of the variable friction damping outer spring. During assembly, only the lower end of the variable friction damping inner spring is fitted into the sunken pit, and since only the variable friction damping inner spring located below the wedge 3 is introduced as the variable friction damping spring 5, the support 7 should have an outer diameter slightly less than that of the variable friction damping inner spring, and thus only the variable friction damping inner spring is pressed.

That is to say, the variable friction damping spring 5 may have two options, where one option is that the variable friction damping spring 5 has only the variable friction damping inner spring, and the outer spring thereof is supported between the bolster 2 and the bearing seat of the side frame 1 to act as a bolster damping spring rather than as a variable friction damping spring. And another option is that the variable friction damping spring 5 has both the variable friction damping inner spring and the variable friction damping outer spring, and the variable friction damping inner spring and the variable friction damping outer spring together act as the variable friction damping spring.

Figure 6:
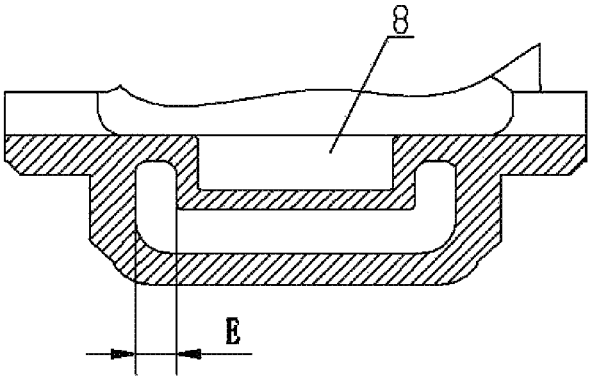
FIG. 6 is a schematic view showing structures of a side of a sunken pit and a sidewall of a bearing seat of the side frame.

Specifically, a distance C between a bottom of the sunken pit 8 and a bottom surface of the bearing seat may be 20% to 50% of a height of the bearing seat of the side frame, and a distance E between a side of the sunken pit 8 and a sidewall of the bearing seat of the side frame may be 20% to 40% of the height of the bearing seat of the side frame (see FIG. 6). This not only facilitates casting, but also can ensure that the variable friction damping spring has a height consistent with or close to those of other bolster springs, thus reducing spring types and reducing the complexity of the structure of the product.

Figure 5:
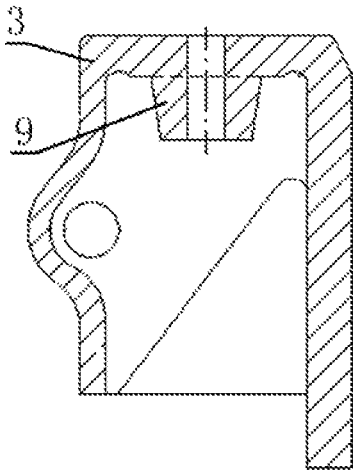
FIG. 5 is a schematic view showing the structure of an inner top surface of the wedge being provided with an inverted conical bulge.

Reference is made to FIG. 5 which is a schematic structural view showing that an inner top surface of the wedge is provided with an inverted conical bulge.

As is shown in the figure, a material of the wedge 3 may be austenitic ductile iron, i.e., ADI. In a case that this material is used, a downward inverted conical bulge 9 may be provided on the inner top surface of the wedge 3 to improve the strength of the wedge 3. The bulge 9 is integrally formed with the wedge 3 and has a root diameter less than an inner diameter of the constant friction damping spring 4, and thus the bulge 9 is capable of inserting into the constant friction damping spring 4. In a case that a top portion of the wedge 3 is provided with an auxiliary hole which is configured to lift and pull the ejector rod so as to position the ejector rod in assembling, the auxiliary hole passes through the bulge 9.

Since in a loaded condition, the wedge 3 mainly pushes, via the inner top surface thereof, the ejector rod 6 to move downward to compress the variable friction damping spring 5. Therefore, by adding the bulge 9, the strength of a contact part of the wedge 3 with the ejector rod 6 can be improved significantly, and further the constant friction damping spring 4 can be positioned and guided, which ensures that the constant friction damping spring 4 is always in an exact location and may not deviate, thereby achieving a better damping effect.

The wedge 3 may be a combined structure, which includes a wedge body and a main friction plate mounted at a facade of the wedge body. The wedge body may be made of a cast iron material and the main friction plate may be made of a non-metallic wear resistant material or a metallic wear resistant material.

As an improvement, an upper end of the ejector rod 6 may be provided with a protruding section, and the protruding section has a diameter less than an outer diameter of the ejector rod. The protruding section may pass upward, via a hole in the top surface of the wedge, through a top surface of the wedge 3, and an exposed portion of the protruding section is provided with an annular groove, which thus can be retained by a spring during assembly, thereby preventing the ejector rod from falling. Or, the exposed portion of the protruding section is provided with a transverse hole, so as to allow a positioning pin to pass through the transverse hole during assembly, thereby preventing the ejector rod from falling likewise.

In addition, the ejector rod 6 may be a steel pipe, an inside of which is a hollow structure. In this way, on the premise that a structural strength of the ejector rod is ensured, material can be saved, a weight of the ejector rod can be reduced and assembly can be facilitated. Further, a top surface of the ejector rod 6 may be designed in a spherical surface to transmit a vertical action force downward better.

Working principles of the above railway freight car bogie are further described hereinafter.

The friction damper includes the wedge 3, the constant friction damping spring 4, the variable friction damping spring 5, the ejector rod 6 and the support 7 and so on. The damper and other components inherent to the bogie including the bolster 2, the side frame 1 and so on, realize the functions of the bogie together. The bottom plate under the wedge groove of the bolster 2 has a through hole. The ejector rod 6 is located inside the constant friction damping spring 4 which is located in the wedge 3, and the lower portion of the ejector rod 6 passes through the through hole of the bottom plate of the wedge groove of the bolster and is in contact with the support 7 placed on the variable friction damping spring 5.

In an unloaded condition, positional relationships between the wedge 3, the constant friction damping spring 4, the variable friction damping spring 5, the side frame 1 and the bolster 2 are described as follows. The constant friction damping spring 4 and the ejector rod 6 are located inside the wedge 3, and the ejector rod 6 passes through the through hole of the bottom plate under the wedge groove of the bolster. The constant friction damping spring 4, the ejector rod 6 and the wedge 3 are fitted together in a space formed by the side frame 1 and the wedge groove of the bolster, and the support 7 is placed on the variable friction damping spring 5, and a top portion of the support 7 is in contact with the ejector rod 6 to transmit a vertical force. Since the constant friction damping spring 4 is in a compressed state, the constant friction damping spring 4 may apply an upward force to the wedge 3. Due to blockage from an inner bevel of the wedge groove of the bolster, the wedge 3 is pressed to a side frame upright column and a positive pressure is generated between the wedge 3 and the side frame upright column. When a car body and the bolster 2 are moved vertically due to movement of a car, a friction force, i.e., a damping force, is generated between the wedge 3 and a wear plate 10 of the side frame upright column, and the friction force is directly proportional to a friction coefficient and a positive pressure between the wedge 3 and the wear plate 10.

Since the bolster 2 has a high position in the unloaded condition, the ejector rod 6 may be in contact with a top surface of an inner cavity of the wedge 3 or may be not in contact with the top surface of the inner cavity of the wedge 3. In a case that the ejector rod 6 is not in contact with the top surface of the inner cavity of the wedge 3, the ejector rod 6 and the variable friction damping spring 5 are not subjected to pressure, and the force pressing the wedge 3 to the side frame upright column is only generated under the action of the constant friction damping spring 4, and the force pressing the wedge 3 to the side frame upright column is set to be small and to be suitable for the unloaded condition. In a case that the ejector rod 6 is in contact with the top surface of the inner cavity of the wedge 3, the ejector rod 6 and the variable friction damping spring 5 are subjected to pressure, and the force pressing the wedge 3 to the side frame upright column is generated under a combined action of the constant friction damping spring 4 and the variable friction damping spring 5, and although the force pressing the wedge 3 to the side frame upright column generated in this case is greater than that in the former case, it may also be set to be suitable for the unloaded condition.

When the car is loaded to be in a loaded condition, all the bolster springs are subjected to an increased vertical force from the car body and the bolster 2, and thus the bolster 2 is moved down, and at this time the top surface of the inner cavity of the wedge 3 moves downward and presses against the upper end of the ejector rod 6, and the force is transmitted through the support 7 to the variable friction damping spring 5, and the generated resilient reaction force acts on the support 7 and is transmitted through the ejector rod 6 to act on the top surface of the inner cavity of the wedge 3 together with the constant friction damping spring 4. In this case, the force is increased compared with that in the unloaded condition, and the positive pressure of the wedge 3 acting on the side frame upright column is also increased accordingly. Since the damping force is directly proportional to the positive pressure, the damping force is also increased, thereby meeting the requirements in the loaded condition.

The above embodiments are merely preferred embodiments of the present application, and specifically, the present application is not limited thereto. Based on the above embodiments, a targeted adjustment can be made depending on practical requirements, thereby obtaining different embodiments. For example, the ejector rod 6 and the support 7 may be made of different kinds of materials to achieve purposes of being lightweight and having a small amount of wear, and the like. Since there are a lot of possible implementations, no more examples are taken and illustrated one by one here.

The bogie has an ideal relative friction coefficient in both the unloaded condition and the loaded condition, and has a large diamond resistant rigidity, a better vertical dynamics performance and a better transverse dynamics performance. For example, in a case that the bogie does not adopt the structure according to the present application, damping of a damping device is typically 20% to 40% in the unloaded condition and 2% to 5% in the loaded condition, and the damping in the loaded condition is too small compared with an ideal value (the ideal value is generally 7% to 15%). In a case that the bogie adopts the structure according to the present application, the damping in the loaded condition may reach 7% to 15%, thereby meeting the requirements of ideal parameters, and furthermore, disadvantages of a conventional bogie with a double-acting damper are overcome and the structural strength of the bolster can be improved significantly, thereby ensuring the service performance of the bogie.

The railway freight car bogie according to the present application is described in detail hereinbefore. Specific examples are applied herein to set forth the principles and embodiments of the present application, and description of the above embodiments is only used to aid in understanding core ideas of the present application. It should be noted that, for the person skilled in the art, various improvements and modifications may be further made to the present application without departing from the principles of the present application, and these improvements and modifications also fall within the scope of claims of the present application.

The invention claimed is:

1. A railway freight car bogie, comprising:

a side frame, a bolster, and a friction damper provided between the side frame and the bolster, wherein the friction damper comprises a wedge, a constant friction damping spring, a variable friction damping spring and an ejector rod, and the bolster is provided with a through hole in a bottom plate under a wedge groove; and an upper portion, passing through the through hole, of the ejector rod is located inside the constant friction damping spring which is located in the wedge, and a lower portion of the ejector rod is in contact with the variable friction damping spring, wherein a variable friction damping spring in the middle and below the wedge is deviated at a distance in a direction away from the center of the bolster with respect to damping springs at two sides of the variable friction damping spring, and an axis of each of the constant friction damping spring and the ejector rod is coincident with an axis of the variable friction damping spring in the middle and below the wedge, wherein a circular sunken pit is provided in a bearing seat of the side frame, and a lower end of the variable friction damping spring is fitted into the sunken pit, wherein a distance of a bottom portion of the sunken pit from a bottom surface of the bearing seat is 20% to 50% of a height of the bearing seat, and a distance of a side of the sunken pit from a side wall of the bearing seat is 20% to 40% of the height of the bearing seat.

2. The railway freight car bogie according to claim 1, wherein a support is provided between a lower end of the ejector rod and an upper end of the variable friction damping spring, and a center line of the support is coincident with the axis of each of the constant friction damping spring and the ejector rod.

3. The railway freight car bogie according to claim 2, wherein a bottom surface of the ejector rod is provided with a conical depression, and a top surface of the support is provided with a conical protrusion matching with the depression.

4. The railway freight car bogie according to claim 3, wherein the ejector rod is a steel pipe having an inside of a hollow structure.

5. The railway freight car bogie according to claim 3, wherein a top surface of the ejector rod is a spherical surface.

6. The railway freight car bogie according to claim 2, wherein the ejector rod is a steel pipe having an inside of a hollow structure.

7. The railway freight car bogie according to claim 2, wherein a top surface of the ejector rod is a spherical surface.

8. The railway freight car bogie according to claim 1, wherein an inner top surface of the wedge is provided with a downward inverted conical bulge, and the bulge has a root diameter less than an inner diameter of the constant friction damping spring.

9. The railway freight car bogie according to claim 8, wherein the ejector rod is a steel pipe having an inside of a hollow structure.

10. The railway freight car bogie according to claim 1, wherein the wedge is a combined structure comprising a wedge body and a main friction plate mounted at a façade of the wedge body.

11. The railway freight car bogie according to claim 10, wherein the ejector rod is a steel pipe having an inside of a hollow structure.

12. The railway freight car bogie according to claim 1, wherein an upper end of the ejector rod is provided with a protruding section having a diameter less than an outer diameter of the ejector rod, and the protruding section passes upward, via a hole of the top surface of the wedge, through a top surface of the wedge, and an exposed portion of the protruding section is provided with an annular groove or a transverse hole.

13. The railway freight car bogie according to claim 12, wherein the ejector rod is a steel pipe having an inside of a hollow structure.

14. The railway freight car bogie according to claim 1, wherein the ejector rod is a steel pipe having an inside of a hollow structure.

15. The railway freight car bogie according to claim 1, wherein the ejector rod is a steel pipe having an inside of a hollow structure.

16. The railway freight car bogie according to claim 1, wherein a top surface of the ejector rod is a spherical surface.

17. The railway freight car bogie according to claim 1, wherein a top surface of the ejector rod is a spherical surface.

* * * * *